United States Patent [19]

Miyagi

[11] 4,207,737

[45] Jun. 17, 1980

[54] APPARATUS FOR CONTROLLING THE AMOUNT OF SECONDARY AIR INJECTION

[75] Inventor: Hideo Miyagi, Susono, Japan

[73] Assignee: Toyota Jidosha Kogyo Kabushiki Kaisha, Toyota, Japan

[21] Appl. No.: 952,858

[22] Filed: Oct. 19, 1978

Related U.S. Application Data

[63] Continuation of Ser. No. 757,474, Jan. 7, 1977, abandoned.

[30] Foreign Application Priority Data

Jul. 28, 1976 [JP] Japan ..... 51-89957

[51] Int. Cl.[2] ..... F01N 3/10

[52] U.S. Cl. ..... 60/276; 60/290

[58] Field of Search ..... 60/276, 289, 290, 294; 123/124 R, 124 B

[56] References Cited

U.S. PATENT DOCUMENTS

| | | | |
|---|---|---|---|
| 1,883,686 | 10/1932 | Geiger | 123/124 B |
| 3,626,915 | 12/1971 | Nakajima | 123/124 B |
| 3,768,259 | 10/1973 | Carnahan | 60/289 |
| 3,931,710 | 1/1976 | Hartel | 123/124 R |
| 3,962,867 | 6/1976 | Ikeura | 60/290 |
| 3,974,651 | 8/1976 | Nakajima | 60/290 |
| 3,975,905 | 8/1976 | Shimo | 60/290 |
| 4,007,718 | 2/1977 | Laprade | 60/276 |
| 4,036,186 | 7/1977 | Hattori | 123/124 R |
| 4,041,915 | 8/1977 | Konishi | 123/119 A |

*Primary Examiner*—Douglas Hart
*Attorney, Agent, or Firm*—Koda and Androlia

[57] ABSTRACT

An apparatus for controlling the amount of secondary air injection including a secondary air injection system which allows the injection of secondary air into an exhaust system for the purpose of causing the combustion of unburned components of the exhaust gas from an internal combustion engine, an air to fuel ratio sensor which determines either the concentration of the oxygen or the concentration of the carbon monoxide in the exhaust gas, a means which senses a sudden acceleration of the internl combustion engine, a control means which sends out an activating signal in response to the output of the air to fuel ratio sensor and the means for detecting a sudden acceleration of the internal combustion engine and a valve means which controls the amount of secondary air injected by the secondary air injection system in response to the activating signal from the control means whereby the valve means causes the amount of secondary air injected into the secondary air injection system to increase when the air to fuel ratio is less than some predetermined value and to decrease if the air to fuel ratio is greater than some predetermined value and to increase the amount of secondary air injected into the secondary air injection system when a sudden acceleration of the internal combustion engine is sensed.

2 Claims, 8 Drawing Figures

APPARATUS FOR CONTROLLING THE AMOUNT OF SECONDARY AIR INJECTION

This is a continuation of application Ser. No. 757,474, now abandoned, filed Jan. 7,1977.

BACKGROUND OF THE INVENTION

1. Field of Invention

This invention relates to means for reducing the pollution in internal combustion engines and more particularly to means for controlling the secondary air injected in an internal combustion engine pollution control system.

2. Description of the Prior Art

To control the pollution of an internal combustion engine, it is frequently necessary to provide a secondary air injection system designed to promote the combustion of the unburned components of the exhaust gas by means of the injection of secondary air into a conventional exhaust system. Such prior art systems typically include a secondary air to fuel ratio sensor in the exhaust system for determining the concentration of oxygen or the concentration of carbon monoxide in the exhaust gas. When the output of this air to fuel ratio sensor varies from a given value, a control valve is regulated by a control circuit which sends out a signal so that the amount of secondary air is increased. The secondary air to fuel ratio of the exhaust gas is established at a theoretical mixture ratio (air excess rate $\lambda$ equals 1), and a catalytic agent or reactor is used to activate combustion.

However, although it is necessary to increase the amount of secondary air injected when the amount of exhaust gas is abruptly increased due to a sudden acceleration of the vehicle and particularly when the amount of gas is increased immediately after shifting gears in automobiles with manual transmissions, the prior art feedback controlled secondary air injection systems for supplying secondary air are not able to keep up with the increase in the amount of exhaust gases. Accordingly, these prior art systems have suffered from a drawback of allowing the emission of large amounts of unburned components of the exhaust gas into the atmosphere due to insufficient combustion of the components (particularly the recombustion of carbon monoxide).

This invention has been designed to eliminate the above mentioned prior art drawback.

SUMMARY OF THE INVENTION

Accordingly, it is a general object of the present invention to provide a means for controlling the amount of secondary air injected into the exhaust system of an internal combustion engine which immediately senses a sudden increase in the acceleration of the internal combustion engine and increases the amount of secondary air injected accordingly.

It is another object of the present invention to provide a means for controlling the secondary air injected into the exhaust system of an internal combustion engine which is simple, reliable and relatively inexpensive.

In keeping with the principles of the present invention, the objects are accomplished with a unique apparatus for controlling the amount of secondary air injection which includes a secondary air injection system which allows the injection of secondary air for the purpose of causing combustion of unburned components of the exhaust gases from the internal combustion engine into the exhaust system of the internal combustion engine, an air to fuel ratio sensor provided in the exhaust system of the internal combustion engine which determines the concentration of the oxygen or the carbon monoxide in the exhaust gas and which generates a output signal in response to the determination, a means for detecting a sudden increase in the speed of the internal combustion engine and which generates an output signal in response thereto, a control means which generates an activation signal in response to the output of the air to fuel ratio sensor and to the output of the means for detecting an abrupt increase in the speed of the internal combustion engine and an air control valve which controls the amount of secondary air injected by the secondary air injection system such that the amount of secondary air injected by the secondary air injection system varies in response to the output of the control means so that the amount of secondary air is increased when the air to fuel ratio decreases below some theoretical value and decreased when the air to fuel ratio increases beyond some theoretical value and increased whenever there occurs a sudden increase in the speed of the internal combustion engine.

BRIEF DESCRIPTION OF THE DRAWINGS

The above mentioned and other features and objects of the present invention will become more apparent by reference to the following description taken in conjunction with the accompanying drawings wherein like referenced numerals denote like elements, and in which.

DETAILED DESCRIPTION OF THE INVENTION

Figure 1:
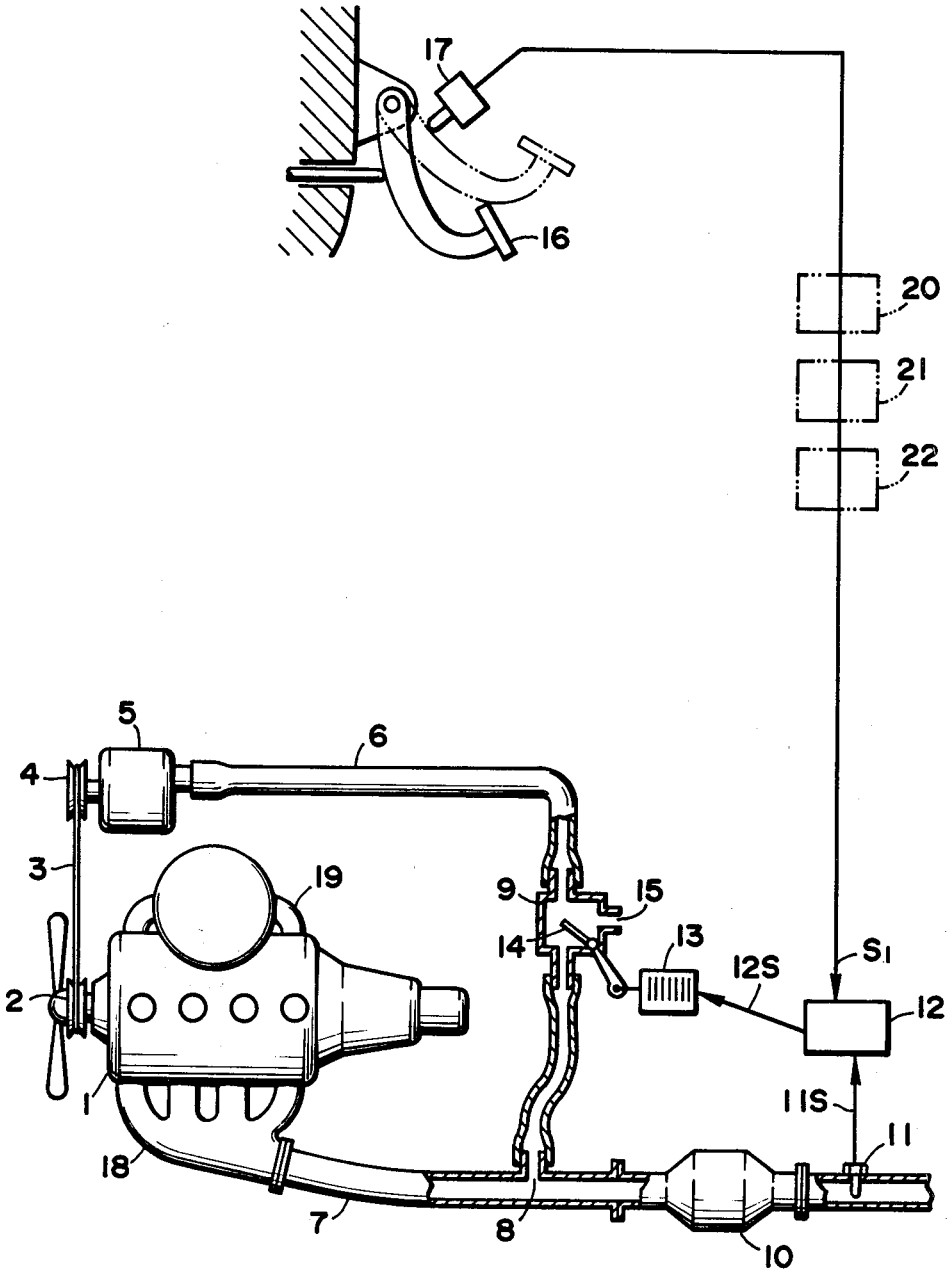
FIG. 1 is an apparatus for controlling the amount of secondary air injection in accordance with the teachings of the present invention.

Referring to FIG. 1, shown therein is an apparatus for controlling secondary air injection in accordance with the teachings of the present invention. As shown in FIG. 1, the discharge side of air pump 5, which is driven engine 1 via pulley 2, belt 3 and pulley 4, is connected to secondary air injection port 8 in the exhaust line 7 by a secondary air supply line 6. An air control valve 9 is installed at an intermediate point in the secondary air supply line 6.

An air to fuel ratio sensor 11 is installed in the exhaust line 7 at a point downstream from the secondary air injection port 8 and the catalytic converter 10. The air to fuel ratio sensor 11 consists of an oxygen detecting device using an oxygen ion conductor such as zirconia, etc., which detects the air excess ratio λ. The output signal 11S of the fuel ratio sensor 11 is transmitted to a control means 12. When the sensor output varies from a given value, the control means 12 determines whether the air excess ratio is greater or less than 1 and sends a signal 12S to increase the amount of secondary air injection if the air excess ratio is greater than 1 to an actuator 13.

The actuator 13 is designed so that it actuates the air control valve 9 in accordance with the signals from the control means 12. The air control valve 9 includes a valve 14 and a secondary air escape port 15. The control means 12 is also coupled to the clutch switch 17 which is installed near the clutch pedal 16. When the clutch pedal 16 is depressed, the clutch switch 17 generates an on-signal S1 to the control means 12. This signal S1 causes the control means 12 to disregard signals from the air to fuel ratio sensor 11 and to send a secondary air increase signal to the actuator 13.

Furthermore, the exhaust 7 is coupled to the engine 1 via an exhaust manifold 18 and the engine 1 is further provided with an intake manifold 19.

In practice, it should be apparent that the implementation of the control means 12 is within the scope of the prior art and many circuits and/or pneumatic or hydraulic devices could be designed which perform the simple functions described herein.

In operation, when the clutch pedal 16 is depressed in order to shift gears, the clutch switch 17 is allowed to generate an "on" signal, thereby causing the control means 12 to disregard signals from the air fuel ratio sensor 11 and to send a secondary air increase signal 12S to the actuator 13. The secondary air increase signal 12S causes the actuator to drive the valve 14 in such a direction that the secondary air escape port 15 is closed, thereby increasing the amount of secondary air transmitted to the secondary air injection port 8 from the air pump 5. When the clutch pedal 16 is released to engage the clutch, the clutch pedal 16 activates the clutch switch 17 which sends an "off" signal to the control means 12. This causes the control means 12 to again operate in response to the signals from the air to fuel ratio sensor 11.

In the above mentioned first embodiment, the system was designed so that the switch 17 is turned on when the clutch pedal is depressed. However, it is also appropriate to use a switch that generates an "off" signal when the clutch pedal 16 is depressed and an "on" signal S1 when it is released. Furthermore, it would also be appropriate, using a switch that is turned off when the clutch pedal 16 is depressed to design the system (as illustrated by the dotted lines in FIG. 1) so that the secondary air increase signal is sent by the control means 12 for only a fixed time period after the clutch pedal 16 is depressed and released. This could be done by installing a differentiating circuit 20, a rectifier circuit 21 and a timer circuit 22 in the line from clutch switch 17 to control means 12. In such a system, the differentiating circuit 20 would differentiate the signal from the switch 17 and the rectifier circuit 21 would select only signals with the same polarity from the differentiating circuit 20. The signals from the rectifying circuit would be applied to the timer circuit 22 which, upon receiving a signal from the rectifier circuit 21, would send an "on" signal to the control means 12 for a fixed period of time.

In practice, the rectifier circuit 21 and differentiating circuit 20 are well known in the art. Furthermore, the timer circuit 22 could be a monostable multi-vibrator, Schmidt trigger circuit, etc. Furthermore, the clutch switch 17 does not necessarily have to be attached in the position shown in FIG. 1, so long as the switch can detect operation of the clutch pedal 16.

Figure 2:
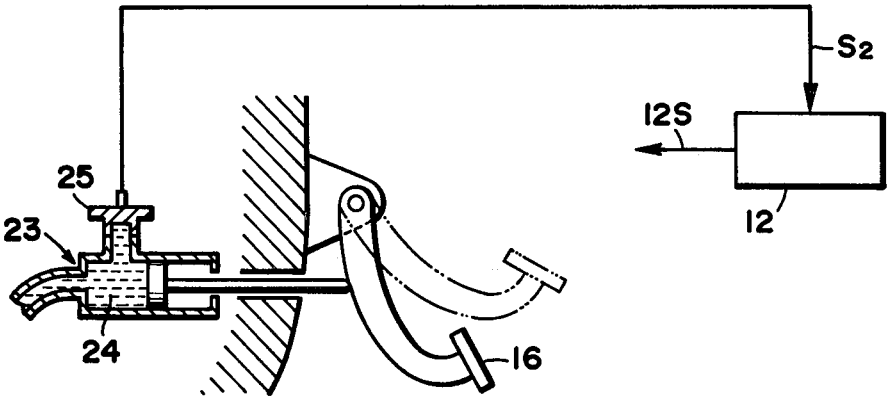
FIG. 2 is a cross-sectional view including partial circuit diagrams which show a second embodiment of an apparatus for controlling the amount of secondary air injection in accordance with the teachings of the present invention.

Referring to FIG. 2, shown therein is a second embodiment of an apparatus for controlling secondary air injection in accordance with the teachings of the present invention. This embodiment is more suitable for use in hydraulic clutch systems and the control means 12 is connected to a pressure switch 25 provided in the pressure chamber 24 of the hydraulic cylinder 23 which is operated by the clutch pedal 16. Since the remaining elements and their operation are identical to those in the aforementioned first embodiment, like elements are given like referenced numerals and their description is omitted here.

In operation, when the clutch pedal 16 is depressed, a pressure increase occurs in the pressure chamger 24 which is detected by the pressure switch 25. The pressure switch 25 generates an "on" signal S2 which is coupled to the control means 12 and causes the control means 12 to generate a secondary air increase signal to the actuator 13 and disregard the signals from the air to fuel ratio sensor 11.

Figure 3:
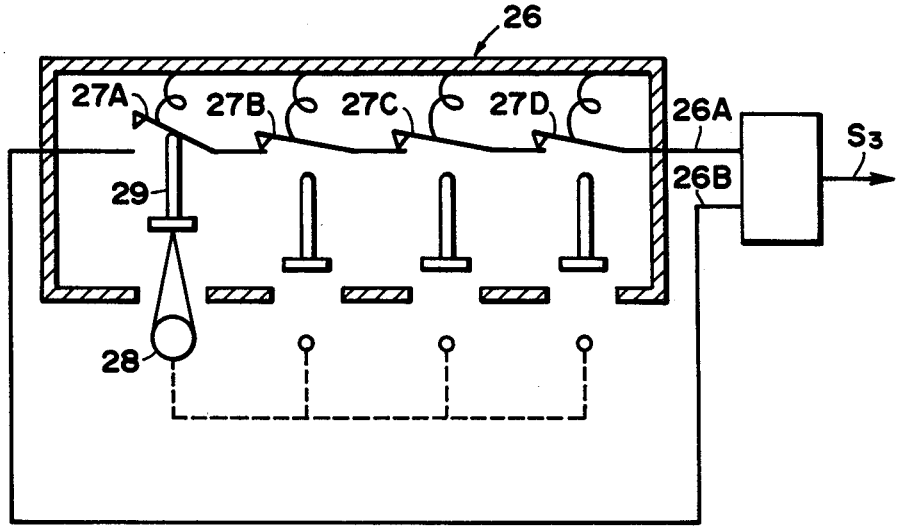
FIG. 3 is a cross-sectional view including partial circuit diagrams of a third embodiment of an apparatus for controlling the amount of secondary air injection in accordance with the teachings of the present invention.

Referring to FIG. 3, shown therein is a third embodiment of an apparatus for controlling secondary air injection in accordance with the teachings of the present invention. In the third embodiment a shift switch 26 is installed as the acceleration detection means. This shift switch 26 is equipped with contacts 27A through 27D which are turned off when the transmission is shifted into a gear. In this example, we are assuming a four-speed transmission. When the shift lever 28 is in the neutral position, all of the contacts 27A through 27D are closed and the shift switch terminals 26A and 26B are shorted together. The contacts 27A through 27D are opened by actuators 29 which are operated by the shift lever 28.

In operation, when the terminal 26A and 26B of the shift switch 26, which are connected to control means 12, are shorted out, a short circuit signal S3 is sent to the control means 12 which in response thereto generates a secondary air increase signal to the actuator 13.

Furthermore, if an open contact signal is used instead of a short circuit signal and the circuits 20, 21 and 22 shown by the dotted lines in FIG. 1 are utilized, it is also possible to design the system so that the secondary air is increased during a short period of time after the shift switch 26 is opened.

Figure 4:
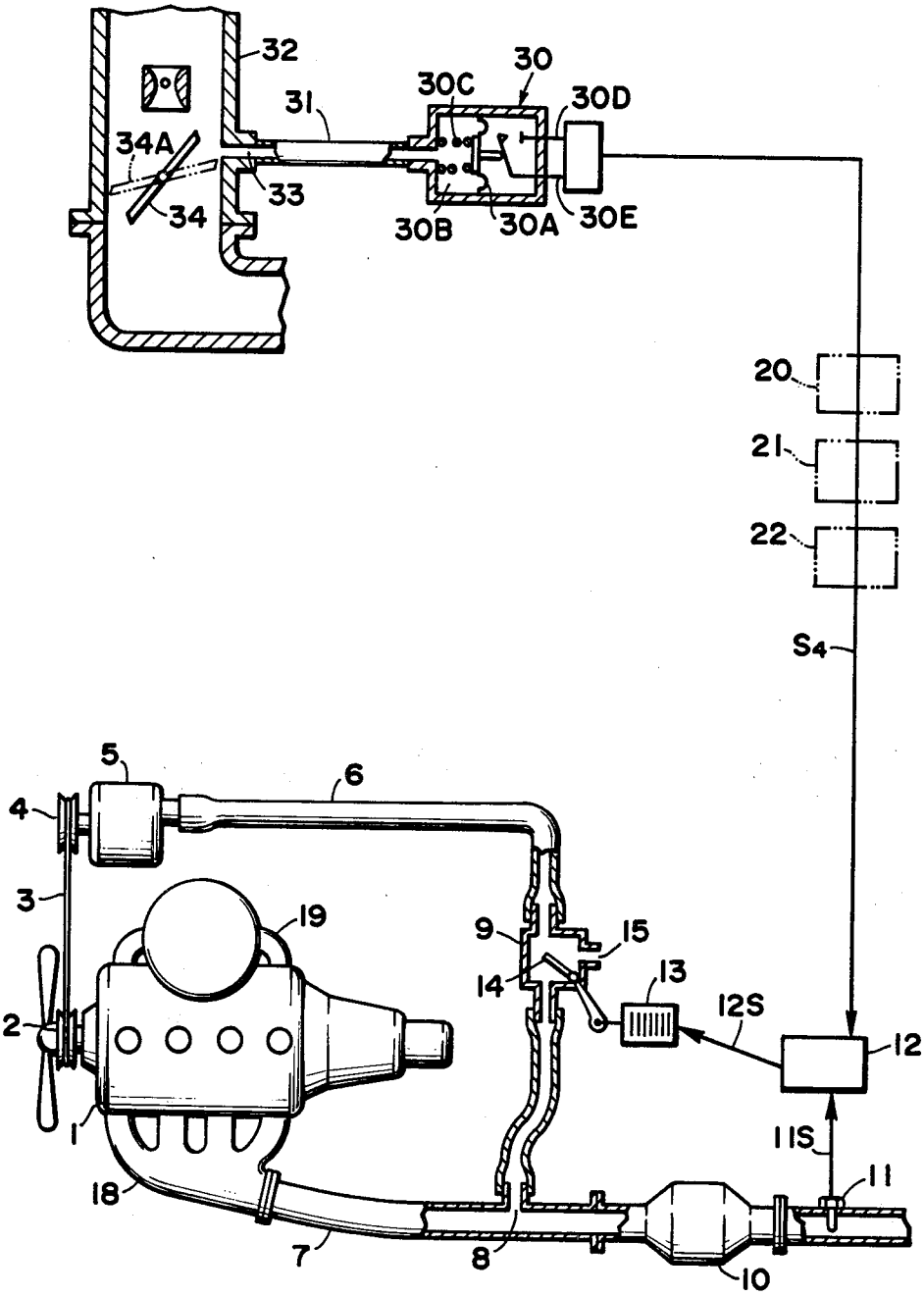
FIG. 4 is a cross-sectional view including a partial circuit diagram of a fourth embodiment of an apparatus for controlling the amount of secondary air injection in accordance with the teachings of the present invention.

Referring to FIG. 4, shown therein is a fourth embodiment of an apparatus for controlling secondary air injection in accordance with the teachings of the present invention. In this fourth embodiment, like elements to those of FIG. 1 are given like referenced numerals.

In the fourth embodiment, a vacuum switch 30 is used as the acceleration detection mechanism. The vacuum switch 30 consists of a vacuum chamber 30B which is compartmentalized by a diaphragm 30A. Spring 38 drives the diaphragm in the direction of expansion of the vacuum chamber 30B. Contacts 30D and 30E are turned on when the diaphragm 30A expands the chamber 30B.

The vacuum chamber 30B is connected to a vacuum port 33 in the carburetor air intake 32 by a vacuum line 31. This vacuum port 33 opens into the air intake at a point slightly upstream from the idle position of the throttle valve 34. When the vacuum present in the vacuum chamber 30B falls below a given level, the contacts 30D and 30E are closed by diaphragm 30A thereby causing a short circuit signal S4 to be sent to the control means 12 which in response thereto sends a secondary air increase signal to the actuator 13.

In operation, when the driver shifts gears, the acceleration pedal is released and the throttle valve 34 is closed almost completely (as shown by the broken line 34A in FIG. 4) thereby causing an abrupt decrease in the vacuum applied to the vacuum port 33. Hence, the vacuum present in the vacuum chamber 30B is also abruptly decreased and the diaphragm 30A moves in a direction of expansion of the vacuum chamber 30B thereby closing contacts 30D and 30E. When the contacts 30D and 30E are closed, a short circuit signal S4 is sent to the control means 12 which activates the air control valve 9 via the actuator 13 so that the amount of secondary air is increased.

It should also be apparent that the operation of the embodiment of FIG. 4 could be modified in a similar manner as described in the embodiment of FIG. 3 by adding the differentiative circuit 20, rectifier circuit 21 and timer circuit 22 shown in dotted lines.

Figure 5:
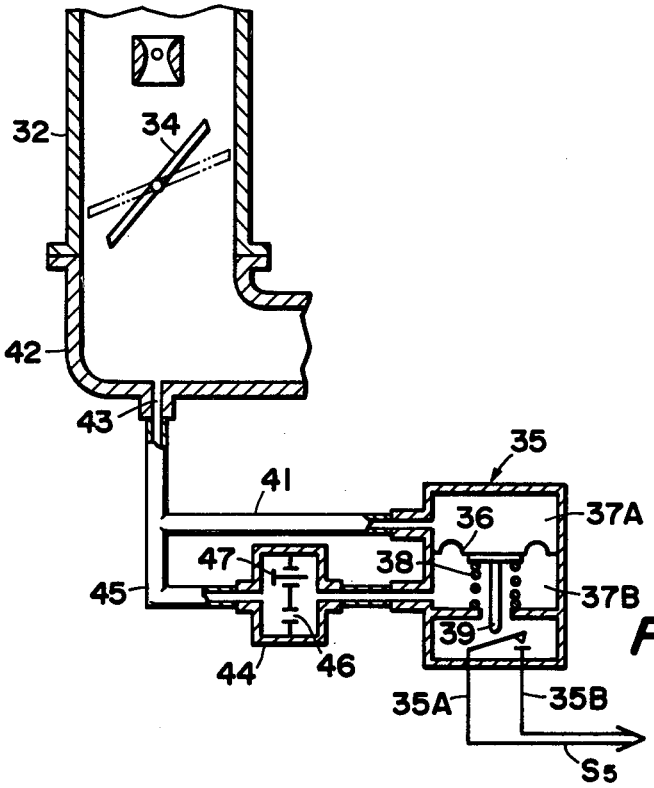
FIG. 5 is a cross-sectional view of a fifth embodiment of a apparatus for controlling the secondary air injection in accordance with the teachings of the present invention.

Referring to FIG. 5, shown therein is a fifth embodiment of an apparatus for controlling secondary air injection in accordance with the teachings of the present invention. In this embodiment, like elements to those of the previous figures are given like referenced numerals.

In the fifth embodiment, a differential pressure switch 35 is installed instead of a vacuum switch 30 used in the fourth embodiment.

This differential pressure switch 35 consists of a diaphragm 36, a primary pressure chamber 37A and a secondary pressure chamber 37B which are separated by a diaphragm 36. Furthermore, a spring 38 drives the diaphragm 36 in a direction of contraction of the primary chamber 37A and an actuator 39 is attached to diaphragm 36 on the secondary pressure chamber 37B side and which causes contacts 35A and 35B to be shorted together when the primary pressure chamber 37A expands.

The primary pressure chamber 37A is connected to a vacuum port 43 in the intake manifold 42 by vacuum line 41. Furthermore, the secondary pressure chamber 37B is connected to vacuum port 43 by a vacuum line 45 which contains transmitting valve 44. The transmitting valve 44 consists of an orifice 46 and an adjacent check valve 47 in parallel. The check valve 47 allows air flow only in the direction running from the secondary pressure chamber 37B to the vacuum port 43. In operation, when the pressure level inside both of the pressure chambers 37A and 37B are equal, spring 38 of differential pressure switch 35 drives the diaphragm so that the contacts 35A and 35B are not closed by the actuator 39. When the driver suddenly accelerates the vehicle, the abrupt opening of the throttle valve 34 causes the pressure level in the intake manifold 42 downstream from the throttle valve to change suddenly from a level approaching a true vacuum to a level approaching atmospheric pressure. When the vacuum in the intake manifold suddenly changes to near atmospheric pressure, the pressure operating upon the vacuum port 43 is immediately transmitted to the primary pressure chamber 37A via the line 41. However, the transmission of the same pressure to the secondary pressure chamber 37D is retarded by the transmitting valve 44, since the check valve 47 is closed in this direction. The increase in pressure from port 43 is slowly transmitted to secondary pressure chamber 37 via orifice 46. Therefore, during the interval between the abrupt opening of throttle valve 34 and the equalization of the pressure levels in the primary and secondary pressure chambers 37A and 37B, the pressure in the primary pressure chamber 37A will be the greater of the two thereby causing diaphragm 36 and the integrally attached actuator 39 to move against spring 38 and close contacts 35A and 35B. The closing of contacts 35A and 35B causes a short circuit signal S5 to be sent to control means 12. This causes the control means 12 to generate a secondary air increase signal to actuator 13 which causes the amount of secondary air injected into exhaust line 7 to be increased. This increased injection continues until the pressure levels in the pressure chambers 37A and 37B equalize and the contacts 35A and 35B are again opened.

Figure 6:
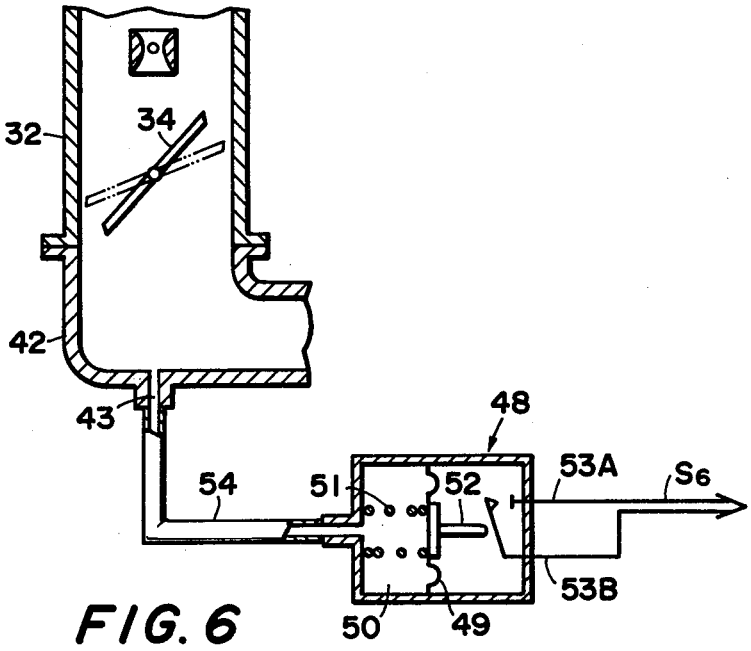
FIG. 6 is a cross-sectional view of a sixth embodiment of an apparatus for controlling the secondary air injection in accordance with the teachings of the present invention.

Referring to FIG. 6, shown therein is a sixth embodiment of an apparatus for controlling secondary air injection in accordance with the teachings of the present invention. In the sixth embodiment, a pressure switch 48 which is activated in response to changes inside the intake manifold 42 is utilized as the acceleration detection means. The pressure switch 48 consists of a diaphragm 49, a pressure chamber 50 which is formed by diaphragm 49, a spring 51 which drives the diaphragm 49 in the direction of expansion of chamber 50, an actuator 52 provided on the diaphragm 49 opposite the pressure chamber and contacts 53A and 53B which are shorted out by the activator 52 when the pressure chamber expands. The pressure chamber 50 is connected to a vacuum port 43 and the intake manifold 42 by a vacuum line 54. The spring 51 is made weak enough so that it can be compressed by the diaphragm 49 when the diaphragm is pulled by the vacuum in the intake manifold when the throttle 34 is closed beyond a given point. Since the remaining components are identical to those in the fourth embodiment, their description is omitted here.

In operation, when the vacuum in the intake manifold 42 shifts towards atmospheric pressure due to the abrupt opening of the throttle valve 34 during sudden acceleration, the pressure level inside the pressure chamber 50 approaches atmospheric pressure. When the pressure inside the pressure chamber 50 approaches atmospheric pressure, the diaphragm 49 and the activator 52 are moved in the direction of expansion of the pressure chamber 50 by this pressure and by the spring 51. The contacts 53A and 53B are shorted together as the diaphragm 49 expands. The shorting out of the contacts 53A and 53B causes a short circuit signal to be sent to the control means 12 which activates the air control valve 9 via the actuator 13 so that the amount of secondary air is increased.

Figure 7:
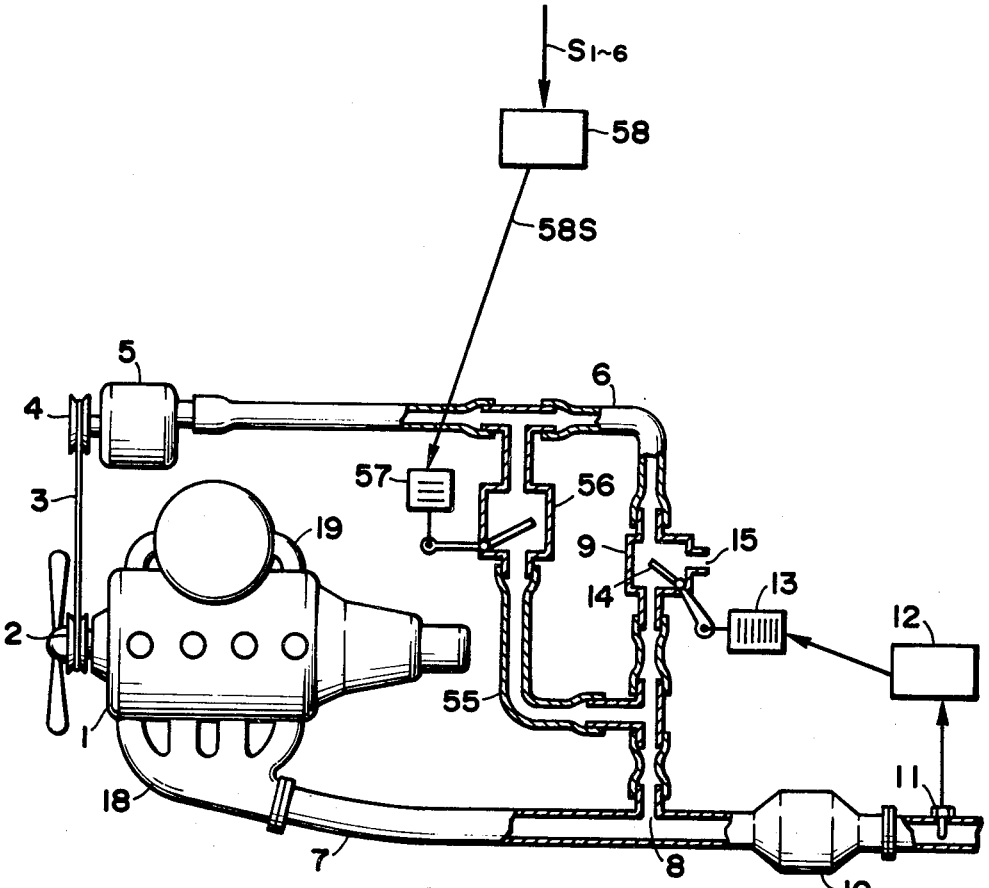
FIG. 7 is a cross-sectional view including a partial circuit diagram of a seventh embodiment of an apparatus for controlling secondary air injection in accordance with the teachings of the present invention.

Referring to FIG. 7, shown therein is a seventh embodiment of an apparatus for controlling secondary air injection in accordance with the teachings of the present invention.

In the seventh embodiment, the system is equipped with a bypass 55 which bypasses the air control valve 9. An air switching valve 56 is provided at an intermediate point in the bypass 55. A secondary actuator 57 is provided which activates the air switching valve 56. A secondary control means 58 which generates a control signal 58S is coupled to the secondary actuator 57. The system is so designed that the imput signal to the secondary control means 58 is only the acceleration detection signals S1 through S6 described in the aforementioned first through sixth embodiments. Furthermore, the primary control means 12 is in this case activated only by the signals from the air to fuel ratio sensor 11. Accordingly, the amount of secondary air delivered to the secondary air injection port 8 is increased by the opening of the air switching valve 56 when the secondary actuator 57 receives a secondary air increase signal from the acceleration detection mechanism via the secondary control means 58. The remainder of the elements of FIG. 7 which are common to those in the other figures are given like referenced numerals and their innerconnection and operation will not be described.

Figure 8:
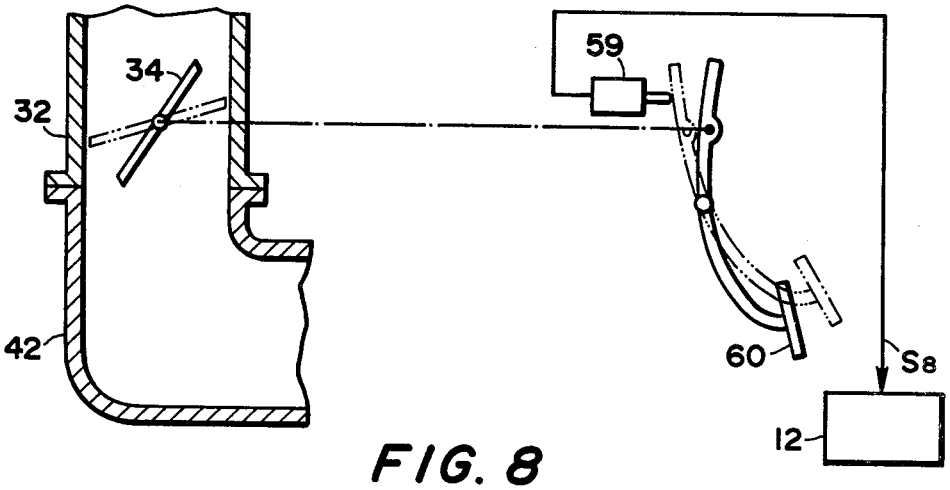
FIG. 8 is a cross-sectional view including a partial circuit diagram of an eighth embodiment of an apparatus for controlling the secondary air injection in accordance with the teachings of the present invention.

Referring to FIG. 8, shown therein is an eighth embodiment of an apparatus for controlling a secondary air injection in accordance with the teachings of the present invention. In this eighth embodiment, an accelerator switch 59 is used as an acceleration detection mechanism. This accelerator switch 59 is installed near the accelerator pedal 60 and is designed so that it is on when the accelerator is not depressed and off when the accelerator pedal is depressed beyond a given point. The control means 12 is so designed that it sends a secondary air increase signal when an "off" signal is transmitted from the accelerator switch 59. Since the remaining components of the eighth embodiment are essentially the same as those shown in the fourth embodiment, they are given the same referenced numerals and the description of their operation and innerconnection is omitted at this point.

In operation, when the engine is started from idle or accelerated after shifting gears, the accelerator pedal 60 is usually depressed from its "release" position. When the acceleration pedal 60 is depressed beyond a given point, the accelerator switch 59 is turned off, thereby causing a signal S8 to be sent to the control means 12 and the control means 12 activates the air control valve 9 via actuator 13 so that the amount of secondary air is increased. At the same time, the control means 12 is caused to disregard the signals from the air to fuel ratio sensor 11 so that feedback control from the air to fuel ratio sensor 11 is terminated. The secondary air increase signal output of the control means 12 is terminated within a short period of time, eg. 1 second, whereupon feedback control of the amount of secondary air injection is resumed by the air to fuel ratio sensor 11. Furthermore, the accelerator switch 59 does not necessarily have to be attached in the position shown in FIG. 8, so long as it can be activated by movement of the accelerator pedal 60.

It should be apparent from the foregoing that with the apparatus for controlling secondary air injection of the present invention, it is possible to sense either quickly or simultaneously any sudden acceleration, eg. after shifting gears, etc., and to increase in response thereto the amount of secondary air injected. Accordingly, the present invention is able to quickly supply the amount of secondary air needed when the amount of unburned components of the exhaust gas is increased thereby causing the combustion of these components. Furthermore, the present invention has been very effectively designed to prevent the emission of large amounts of carbon monoxide into the atmosphere In all cases, it is understood that the above described embodiments are merely illustrative of but a few of the many possible specific embodiments which can represent application of the principles of the present invention. Numerous and varied other arrangements can be readily devised in accordance with these principles by those skilled in the art without departing from the spirit and scope of the invention.

I claim:

1. Apparatus for controlling the amount of secondary air injected into an exhaust pipe of an internal combustion engine for causing the combustion of unburned components of the exhaust gas from said internal combusion engine comprising:

air to fuel ratio sensor which senses the concentration of oxygen or carbon monoxide in the exhaust gas;

a means for sensing only a sudden acceleration of said internal combustion engine, said means for sensing sudden acceleration of the internal combustion engine comprising a differential pressure switch actuated by the pressure in an intake manifold of said internal combustion engine, said differential pressure switch being arranged and configured such that said differential pressure switch is actuated for some predetermined time after only a sudden acceleration of said internal combustion engine occurs;

a control means for generating a signal which is responsive to the output of said air to fuel ratio sensor and to said means for sensing only a sudden acceleration of the internal combustion engine;

a valve means for controlling the amount of secondary air injected into said exhaust pipe, said valve means being controlled by said control means such that the valve means causes the amount of secondary air injected into the exhaust pipe to increase or decrease in response to the output of the air to fuel ratio sensor and to suddenly increase the amount of secondary air injected into the exhaust system only when a sudden acceleration of the internal combustion engine is sensed by said means for sensing only a sudden acceleration;

whereby the amount of secondary air injected is suddenly increased only when a sudden acceleration of the internal combustion engine is sensed.

2. An apparatus according to claim 1 wherein said differential pressure switch comprises:

the primary pressure chamber coupled directly to said intake manifold at a point downstream of a throttle valve in an intake of said engine;

a secondary pressure chamber coupled to said intake manifold at a point downstream of a throttle valve in an intake of said engine via a transmitting valve consisting of parallel combination of an orifice and a check valve;

a diaphragm separating said primary and secondary pressure chambers;

a spring driving said diaphragm in a direction of contraction of said primary pressure chamber;

an actuator coupled to said diaphragm and provided in said secondary pressure chamber; and a switch means provided in said secondary pressure chamber and actuated by said actuator when pressure in said primary pressure chamber exceeds the pressure in said secondary pressure chamber.

* * * * *